United States Patent [19]

Gässler et al.

[11] Patent Number: 4,513,712

[45] Date of Patent: Apr. 30, 1985

[54] APPARATUS FOR REGULATING THE IDLING RPM IN AN INTERNAL COMBUSTION ENGINE

[75] Inventors: Hermann Gässler, Vaihingen/ENZ; Wolfgang Kosak, Mölingen, both of Fed. Rep. of Germany

[73] Assignee: Robert Bosch GmbH, Stuttgart, Fed. Rep. of Germany

[21] Appl. No.: 615,874

[22] Filed: May 31, 1984

Related U.S. Application Data

[63] Continuation of Ser. No. 417,936, Sep. 14, 1982, abandoned.

[30] Foreign Application Priority Data

Dec. 11, 1981 [DE] Fed. Rep. of Germany ..... 3149097

[51] Int. Cl.[3] ..... F02D 11/10

[52] U.S. Cl. ..... 123/339; 123/352

[58] Field of Search ..... 123/339, 352

[56] References Cited

U.S. PATENT DOCUMENTS

| | | | |
|---|---|---|---|
| 4,191,051 | 3/1980 | Kawata et al. | 123/339 |
| 4,237,838 | 12/1980 | Kinugawa et al. | 123/339 |
| 4,278,059 | 7/1981 | Collonia | 123/399 |
| 4,306,527 | 12/1981 | Kinugawa et al. | 123/339 |
| 4,344,397 | 8/1982 | Geiger et al. | 123/339 |
| 4,365,601 | 12/1982 | Yamazoe et al. | 123/339 |
| 4,381,746 | 5/1983 | Miyagi et al. | 123/339 |
| 4,389,996 | 6/1983 | Yaegashi et al. | 123/339 |
| 4,397,275 | 8/1983 | Itoh et al. | 123/339 |
| 4,399,789 | 8/1983 | Yano | 123/339 |
| 4,441,471 | 4/1984 | Kraft et al. | 123/339 |

*Primary Examiner*—Raymond A. Nelli

*Attorney, Agent, or Firm*—Edwin E. Greigg

[57] ABSTRACT

An apparatus is proposed for regulating the idling rpm in an internal combustion engine. The apparatus has a PI regulator which has an insensitivity control circuit associated with it. Minimum and maximum value limiting circuits are furthermore provided, their thresholds being dependent on operating characteristics. Finally, a D element circuit cooperates with the PI regulator. The D element is subject to a threshold, and it comes into effect only when the rpm is dropping, its function being such as to steepen the I component of the PI regulator.

8 Claims, 3 Drawing Figures

APPARATUS FOR REGULATING THE IDLING RPM IN AN INTERNAL COMBUSTION ENGINE

This is a continuation of copending application Ser. No. 417,936, filed Sept. 14, 1982, now abandoned.

BACKGROUND OF THE INVENTION

In view of rising energy prices, the regulation of the idling rpm in internal combustion engines assumes ever-increasing importance because while it is desirable to have the selected idling rpm as low as possible for reasons of fuel consumption, there is a certain level of reliability that must be provided for the energy consumers in the vehicle which must be switched on and off. Air conditioners, for example, or switching gears in an automatic transmission, both of which involve an increased load on the engine such that if the safety margin beyond the lowest possible idling rpm becomes too narrow, there is a danger that the engine might stall.

A known idling rpm regulator includes a bypass conduit of controllable cross section disposed parallel to the throttle valve. The triggering is effected by means of a proportional-integral-derivative controller or PID regulator, the input variables of which are signals relating to the rpm, the actuation of the idling switch and the temperature. The bypass cross section is controlled by means of a clocked magnetic valve.

In practical operation, it has been found that with the known apparatus, the above problem cannot yet be solved optimally in terms of both fuel consumption and the lowest possible, reliably controlled idling rpm.

OBJECT AND SUMMARY OF THE INVENTION

With the apparatus according to the invention as-described hereinafter, the idling rpm can be controlled reliably down to quite low levels, while at the same time the operating reliability of the engine is quite high. Further improvements are attainable by means of PI regulation coupled with an insensitivity control circuit, minimum and maximum limiting circuits, and a D element circuit.

The invention will be better understood and further objects and advantages thereof will become more apparent from the ensuing detailed description of one preferred embodiment taken in conjunction with the drawings.

DESCRIPTION OF THE PREFERRED EMBODIMENT

The exemplary embodiment relates to an apparatus for regulating the idling rpm in an internal combustion engine having externally supplied ignition. In the course of this regulation, the cross section of a bypass conduit bypassing the throttle valve is varied (see U.S. Ser. No. 287,003, filed July 27, 1981, Bonse et al), and an electromagnetic control element triggered in pulsed fashion is used, such as shown as the electromagnetic final control for varying the cross-section of a conduit 25 in U.S. Pat. No. 4,265,200.

Figure 1:
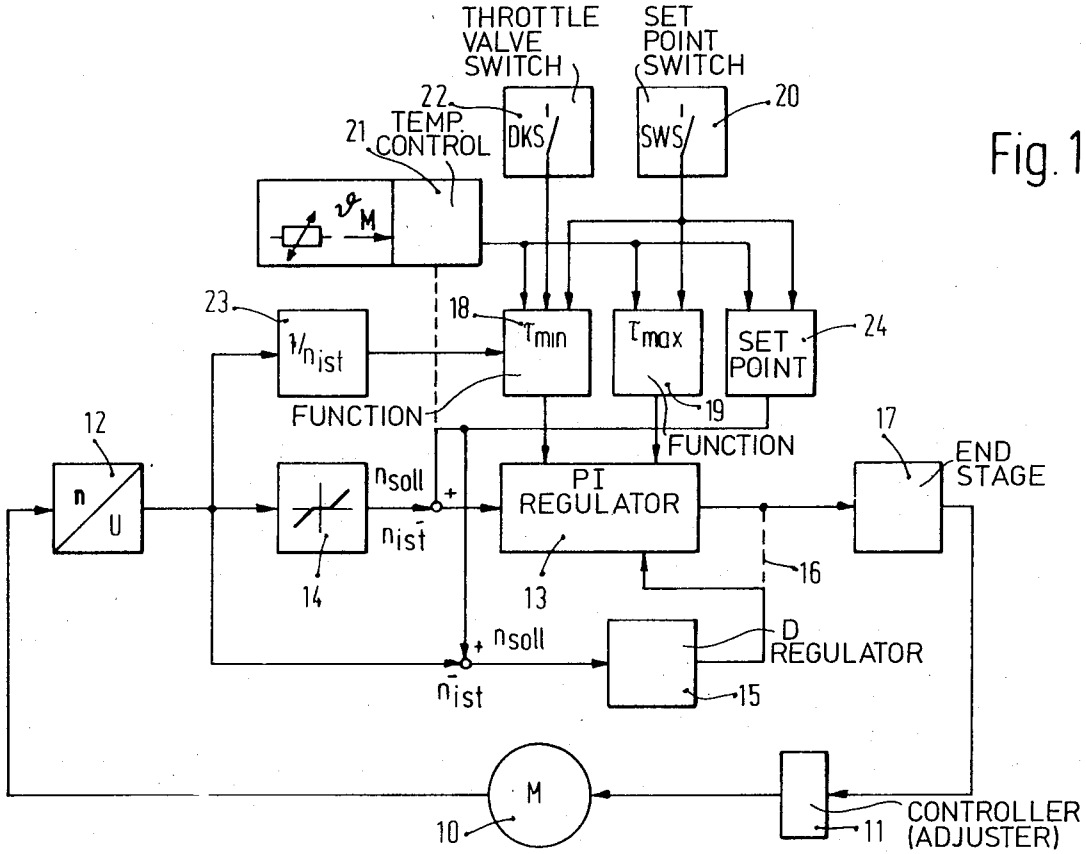
FIG. 1 is a rough block circuit diagram of the apparatus according to the invention for regulating the idling rpm in an Otto-type internal combustion engine.

The engine itself is marked 10 and it has a control element 11, for example, an electromagnetic device for controlling the bypass cross section and an rpm sensor 12. The primary characteristic of the regulating apparatus of FIG. 1 is a PID regulator 13 having a preceding insensitivity control circuit 14. Disposed parallel to blocks 13 and 14 is a D regulator which discharges either into the PI regulator 13 or, as indicated by a dashed line 16, into the connecting line between the PI regulator 13 and an end stage 17, which furnishes the trigger signal for the control element 11. Limiting circuits for minimum and maximum opening of the bypass cross section are indicated at 18 and 19, respectively. They, too, send their output to the PI regulator 13. On the input side, these limiting circuits 18 and 19 receive signals from a switching circuit set-point switch (or drive switch) 20 and from a temperature signal evaluation circuit 21. The limiting circuit 18 for the minimum bypass opening additionally receives a signal from a throttle valve switch 22 and from an rpm signal reversing circuit 23. A set-point circuit 24 furnishes the set-point value for the PI regulator and the D regulator. On its input side, the set-point circuit 24 is connected with the switching circuit 20 and the temperature signal evaluation circuit 21.

In detail, the subject of FIG. 1 functions as follows:

The actual rpm value for regulation is obtained in block 12 by means of converting the ignition pulses into an rpm-proportional voltage.

The temperature signal evaluation circuit 21 forms a temperature-dependent control voltage based on the coolant temperature $\theta_M$ indicated by an NTC resistor. A reference voltage derived from the stabilized supply voltage is varied in the set-point circuit 24 component, in accordance with output signals from the temperature signal evaluation circuit 21 and the switching circuit 20 and then delivered as a set-point value to the PI regulator 13 and the D regulator 15.

In the PI regulator 13, the amplification of the PI component can be switched over into two ranges by means of the preceding insensitivity control circuit 14. The amplification factors both within and outside the freely selectable insensitivity range are selected in terms of a particular intended usage. The D regulator 15 is designed such that it responds solely in the range where $n_{soll}$ [set-point rpm] $\leqq n_{ist}$ [actual rpm] $\leqq N_{max}$ [maximum rpm] when dn/dt is less than zero.

The regulator compares the actual rpm with the set-point rpm, and if there is a deviation it readjusts the opening cross section of the throttle valve bypass via the end stage 17. The change thus dictated in the quantity of air aspirated by the engine is detected by an air flow rate meter, and the rpm of the engine is varied accordingly via an injection quantity control unit, not shown. The D regulator 15 additionally has a response threshold, so that during normal regulating operation ($n_{soll} \pm 20 \ldots 50$ rpm) it is not set. This feature and the reduced amplification of the PI regulation taking place in the insensitivity range (approximately $n_{soll} \pm 80 \ldots 100$ rpm) both bring about an improvement in the smoothness of the engine operation.

Extreme load changes during idling operation, for instance when switching into "drive" in the case of an auto-automatic transmission, or when switching on an air conditioner, cause rpm fluctuations beyond the insensitivity range. The rapid and reliable control of such operating states is assured, therefore, by the increased amplification of the PI regulator outside the insensitivity range.

The minimum and maximum cross sections of the throttle valve bypass are adjustable in accordance with operating characteristics via the blocks 18 and 19. The maximum value limiting circuit 19 limits the rpm during engine starting by limiting the bypass air quantity. The limitation is effected primarily during warm starting, that is, when the engine is at operating temperature. Without any limitation, for example, the total adjuster cross section $a_{smax}$ ($\triangleq \tau=1$) would be established, and the engine speed would increase up to 2900 rpm.

In fact, $\tau_{max}$ is limited to 0.7, for example, resulting in an engine speed of approximately n=1800 rpm. In order that a sufficiently large cross section will be available during cold starting, the $\tau_{max}$ limitation is dependent on temperature, so that at −30 ° C., for example, $\tau_{max}=1$ can be established.

The minimum-value limitation becomes critically important, because it has a dual function:

First, it serves as an aid to intercepting extreme operating conditions, such as fluctuating rpm in the lower load range or load jumps, by increasing the minimum cross section of the bypass when the throttle valve closes but reducing it when the set-point switch is actuated (while changing gears) and additionally controlling it in accordance with engine temperature and rpm. Secondly, during operation up to a predetermined rpm, it serves to increase the bypass air quantity continuously in a manner which is controlled via the rpm signal reversing circuit 23. As a result, it counteracts leaning down of the fuel-air mixture during overrunning (that is, when the throttle valve is closed but the throttle valve bypass is partially opened), and in this manner improves exhaust emission values (primarily reducing peaks in hydrocarbon emissions).

Figure 2:
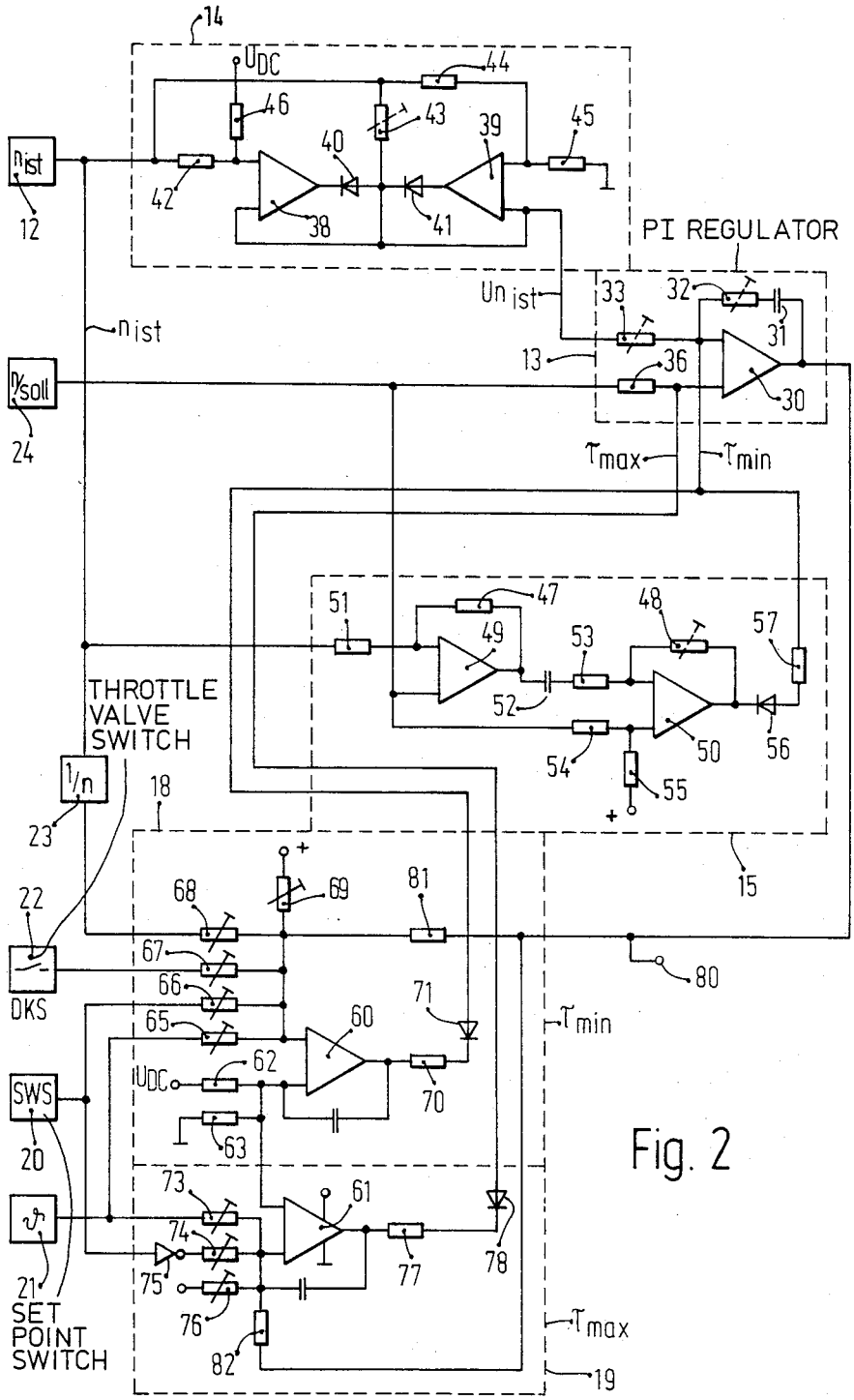
FIG. 2 is a detailed circuit diagram for the parts of the subject of FIG. 1 of particular importance to the invention.

Details of the subject shown in FIG. 1 in the form of a block circuit diagram are provided in FIG. 2. Components which are equivalent to those of FIG. 1 are identified by the same reference numerals. The PI regulator 13 of FIG. 2 includes an operational amplifier 30, which is inversely coupled via a series circuit comprising a capacitor 31 and a resistor 32. The negative input of the operational amplifier 30 is connected via a resistor 33 with the output of the insensitivity control circuit 14 and is additionally connected directly with the minimum value limitation circuit 18 and with the D element 15. An rpm set-point signal from the set-point circuit 24 is carried to the positive input via a resistor 36, as is the output signal of the maximum value limitation circuit 19.

The insensitivity control circuit 14 includes two operational amplifiers 38 and 39, the negative inputs of which are combined and form the output of this circuit. The two outputs of the operational amplifiers 38 and 39 are coupled with one another via a series circuit of two diodes 40 and 41, the connecting point of which is again carried to the output. An rpm signal travels from the rpm/voltage converter 12 via a resistor 42 to the positive input of the operational amplifier 38, via a resistor 43 to the connecting point of the two diodes 40 and 41 and via a resistor 44 to the positive input of the operational amplifier 39, which is additionally connected to ground via a resistor 45. The operational amplifier 38 is supplied with positive voltage in a corresponding manner via a resistor 46.

The D element includes two amplifiers 49 and 50, which are inversely coupled via respective resistors 47 and 48. An actual rpm signal travels via a resistor 51 to the negative input of the amplifier 49, and on the output side this amplifier 49 is coupled via a capacitor 52 and a resistor 43 with the negative input of the amplifier 50. A set-point rpm signal is received directly by the positive input of the amplifier 49 and by the positive input of the amplifier 50 via a resistor 54; this latter positive input is additionally connectable via a resistor 55 with the source of operating voltage. From the output of the amplifier 50, a series circuit comprising a diode 56 and a resistor 57 leads to the negative input of the operational amplifier 30 of the PI regulator 13.

The primary characteristic of the minimum and maximum limiting circuits 18 and 19 are respective inversely coupled amplifiers 60 and 61. A voltage divider comprising two resistors 62 and 63 and located between the two operating voltage connections supplies the same potential to both the negative input of the amplifier 60 and the positive input of the amplifier 61. The positive input of the amplifier 60 receives a temperature signal from the temperature signal evaluating circuit 21 via a resistor 65, a signal from the switching circuit 20 via a resistor 66, a signal from the switching circuit 22, via resistor 67, a reciprocal rpm signal via a resistor 68 and finally a positive signal via a resistor 69. On the output side, the amplifier 60 is connected via a resistor 70 and a diode 71 with the negative input of the operational amplifier 30 of the PI regulator 13.

A temperature signal is carried via a resistor 73 to the negative input of the amplifier 61 of the maximum value limiting circuit 19, while a signal from the switch 20 is carried to the same negative input via a resistor 74 and an inverter 75; finally, a positive voltage signal is supplied to this input via a resistor 76. On the output side, the amplifier 61 is connected via a resistor 77 and a diode 78 with the positive input of the operational amplifier 30.

The output of the circuit apparatus shown in FIG. 2 is embodied by a terminal 80, which is connected directly with the output of the operational amplifier 30 of the PI regulator 13 and also via respective resistors 81 and 82 with the positive and negative inputs, respectively, of the amplifiers 60 and 61.

In detail, the units in the circuitry of FIG. 2 function as follows:

The insensitivity control circuit 14 comprises two antiparallel, ideal diodes. The lower threshold of the insensitivity range is fixed by means of the voltage divider having the resistors 42 and 46. Above the insensitivity range, the diode 41 is conductive; below this range, the diode 40 is conductive. The resistor 43 is then without a function. For the following PI regulator 13, outside the insensitivity range, the equation $K_o=R32/R33$ applies for the proportional component, and for the time constant of the integral component, the equation $T_o=R33 \cdot C31$ applies. Within the insensitivity range, the two diodes 40 and 41 are blocked, and the signal travels via the resistor 43. In that case, these equations apply for the proportional component and the time constant, respectively:

$$K=R32/(R33+R43);\ T=(R33+R32)\cdot C31.$$

Figure 3:
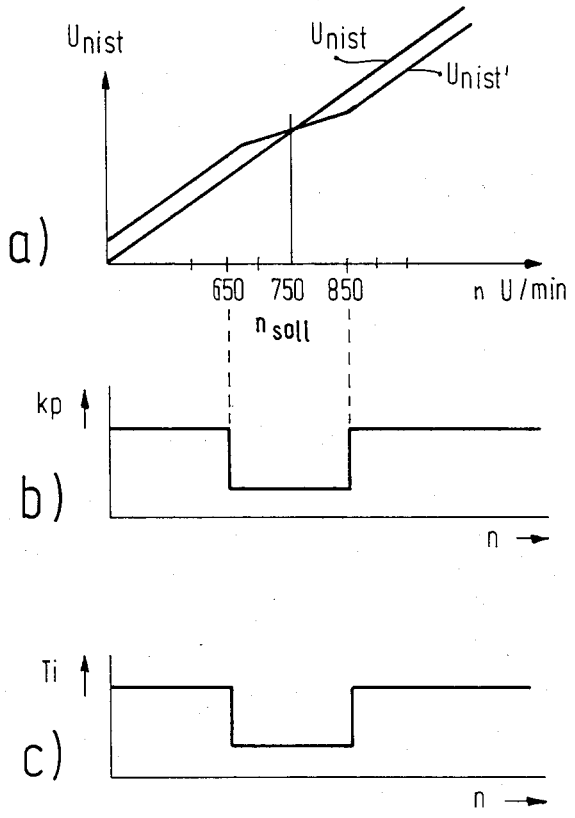
FIG. 3 is a pulse diagram relating to a specialized component of FIGS. 1 and 2, respectively.

The magnitude of the insensitivity range in rpm is a product of the inclination of the input characteristic curve $s = \Delta U\ nist/\Delta n$ and the dimensioned insensitivity range ΔUE: Δn=ΔUE/S. These relationships are shown in detail in FIG. 3. There, FIG. 3*a* shows the output signal of the insensitivity control circuit 14 plotted over the rpm, in this case symmetrically with respect to $n_{soll}$=750 rpm. A medium range can be seen which has a relatively flat inclination, located within the range from 650 to 850 rpm. These values have proved to be favorable for one special engine type. Deviations in one or the other direction are naturally possible for other engine types. From this diagram, it can be seen that an amplified change in the output signal of this circuit 14 takes place outside the insensitivity range, which thus also brings about a greater counteraction of the deviation.

FIG. 3*b* shows the relationships in the proportional component of the PI regulator 13, plotted over the rpm, and FIG. 3*c* shows the time constant of the integral regulator, again plotted over the rpm. It can be seen that in the insensitivity range, the individual values decrease.

The PI regulator 13, together with the D element 15, makes up a conventional PI regulator having an amplifier dynamically acting in a unilaterally proportional manner on the PI regulator. The D component influences the PI regulator only when the rpm is dropping, since acceleration and deceleration processes must be evaluated differently with respect to the idling regulator.

During regulated operation (that is, when the setpoint value approximately equals the actual value), the reversing amplifier 49 transmits the waviness of the actual rpm voltage signal to the actual D element having the amplifier 50, which amplifies this signal by the factor V=R48/R53. The voltage divider having the two resistors 54 and 55 provides the D component with an adjustable threshold. As a result, and because of the finite threshold of the diode 56, a slight pulsation in the actual rpm signal does not influence the PI regulator 13.

The D component responds only at changes above 100 rpm. The following equation, in a first approximation, thus applies to the PI regulator:

$K_o = R32/R57,\ T_o = R57 \cdot C31.$

The increase in the amplification factors amounts to approximately 10 to 30, so that the PI regulator very rapidly arrives at its limit ($\tau_{max}$) and opens the throttle valve bypass conduit.

The minimum value limiting circuit 18 serves to limit the lower output voltage of the PI regulator 13. In the active state, the amplifier 60 embodies an additive amplifier, the positively coupled branch of which is formed by the PI regulator and the resistor 81. In order to avoid extremely frequent switching of the amplifier 60 in the active state, a capacitive inverse coupling is provided.

The limitation is effected if the regulator output voltage drops below a predetermined value. In that case, the output voltage of the amplifier 60 drops, the diode 71 becomes conductive and the output voltage of the regulator 13 is increased once again via the resistor 70. The voltage at the output of the amplifier 60 thereupon increases, and the diode 71 then blocks once again. The result is an oscillating output signal at the output of the PI regulator, within predetermined limits.

In order to enable the minimum value limitation to react dynamically fast, a large amplification Kp and a short adjusting time Ti (analogous to the D action) are selected, as follows:

$K_p = R32/R70,\ Ti = R70 \cdot C31.$

In the active state of the operational amplifier 60, the individual signal input variables via the resistors 65-68 function additively. In the passive state, the summing voltage at the positive input of the amplifier 60 is greater than the corresponding voltage at the negative input, so that the output signal is continuously at high potential and the diode 71 is blocked.

The output signal of the maximum value limiting circuit 19 limits the upper output voltage of the PI regulator 13. In the active state, the amplifier 61 embodies an additive amplifier or integrator, the positively coupled branch of which comprises the PI regulator 13 and the resistor 82. The capacitor in the capacitive inversely coupled branch of the amplifier 61 provides an I function to the apparatus, thus avoiding extremely frequent switching during the limitation. The limitation itself is effected in this case with reversed polarities corresponding to the functioning of the minimum value limiting circuit 18.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An apparatus for regulating the idling rpm of an internal combustion engine in a manner to prevent stallout below critically low idle rpms incurred during accessory loading of the engine, comprising sensor means for the actual rpm and the temperature of said engine, a PI regulator for processing the output signal of said actual rpm sensing means and a signal related to the output signal of said temperature sensing means, and a control circuit acting on said actual rpm signal for changing the actual rpm signal input to said PI regulator to thereby permit the amplified PI-component to be switched into two ranges by means of said control circuit.

2. A method employing a PI regulator for regulating the idling rpm of an internal combustion engine in a manner to prevent stallout below critically low idle rpms incurred during accessory loading of the engine, comprising the steps of sensing the actual rpm and the temperature of said engine, processing the output signal of said actual rpm and a signal related to said temperature in said PI regulator, and modifying the actual rpm input signal to said PI regulator to permit the amplified PI component to switch into two ranges.

3. An apparatus as defined by claim 1 or 2, wherein the control circuit comprises a diode-resistor-amplifier network including two parallel connected ideal diodes connected in opposite directions to each other.

4. An apparatus as defined by claim 1, further comprising, a minimum value limiting circuit (18) coupled with the PI regulator, the threshold values of which are dependent on operating characteristics of the engine.

5. An apparatus as defined by claim 1, further comprising, a maximum value limiting circuit (19) coupled with the PI regulator, the threshold values of which are dependent on operating characteristics of the engine.

6. An apparatus as defined by claim 1, further comprising a circuit means (15) having an rpm dependent input signal acting as a D component and coupled with the PI regulator.

7. An apparatus as defined by claim 6, wherein the circuit means (15) acting as the D component has a threshold-value response and behaves unilaterally.

8. An apparatus as defined by claim 6 or 7, wherein the circuit means (15) acting as the D component acts upon the I component of the PI regulator (13) such as to produce a steep inclination of the input characteristic curve thereof.

* * * * *